US012747076B2

(12) United States Patent
Scherer et al.

(10) Patent No.: US 12,747,076 B2
(45) Date of Patent: Sep. 29, 2026

(54) CLOSURE WITH RETAINING RING AND TAMPER EVIDENCE BAND

(71) Applicant: HUSKY INJECTION MOLDING SYSTEMS LTD., Bolton (CA)

(72) Inventors: Stephan Scherer, Trierweiler (DE); Thomas Ara, Boucheporn (FR); Jaroslav Habich, Jindrichuv Hradec (CZ)

(73) Assignee: Husky Injection Molding Systems Ltd., Bolton (CA)

( * ) Notice: Subject to any disclaimer, the term of this patent is extended or adjusted under 35 U.S.C. 154(b) by 0 days.

(21) Appl. No.: 18/555,823

(22) PCT Filed: Apr. 25, 2022

(86) PCT No.: PCT/CA2022/050630
§ 371 (c)(1),
(2) Date: Oct. 17, 2023

(87) PCT Pub. No.: WO2022/232907
PCT Pub. Date: Nov. 10, 2022

(65) Prior Publication Data

US 2024/0208701 A1 Jun. 27, 2024

Related U.S. Application Data

(60) Provisional application No. 63/184,297, filed on May 5, 2021.

(51) Int. Cl.
*B65D 55/16* (2006.01)
*B65D 5/74* (2006.01)
(Continued)

(52) U.S. Cl.
CPC ..... *B65D 55/16* (2013.01); *B65D 5/748* (2013.01); *B65D 41/3428* (2013.01);
(Continued)

(58) Field of Classification Search
CPC .... B65D 55/16; B65D 5/748; B65D 41/3428; B65D 51/222; B65D 2251/0015;
(Continued)

(56) References Cited

U.S. PATENT DOCUMENTS 6,357,628 B1 * 3/2002 Long, Jr. ..... B65D 41/3447 222/541.6
2009/0084751 A1 * 4/2009 Pucci ..... B65D 41/3428 215/217

(Continued)

FOREIGN PATENT DOCUMENTS

CA 3137383 A1 11/2020
CN 102652098 A 8/2012

(Continued)

OTHER PUBLICATIONS

English translation of WO 2021018772 (Year: 2021).*

(Continued)

*Primary Examiner* — James N Smalley
*Assistant Examiner* — Eric C Baldrighi
(74) *Attorney, Agent, or Firm* — Wolf, Greenfield & Sacks, P.C.

(57) ABSTRACT

A closure assembly for a carton, which includes a closure, a neck to which the closure is mounted and a cutter received within the neck for piercing a foil of the carton. The closure includes a retaining ring for securement around the container neck below an annular flange of the neck, a lid pivotally connected to the retaining ring and a tamper evidence band frangibly connected to the retaining ring. The closure engages the cutter when it is rotated, which causes the cutter to pierce the foil of the carton as the closure is opened. The tamper evidence band has a rotational stop which engages a rotational stop of the container neck to separate the tamper
(Continued)

evidence band from the retaining ring on first rotation of the closure in the opening direction.

10 Claims, 10 Drawing Sheets

(51) Int. Cl.
*B65D 41/34* (2006.01)
*B65D 51/22* (2006.01)

(52) U.S. Cl.
CPC .... *B65D 51/222* (2013.01); *B65D 2251/0015* (2013.01); *B65D 2251/0093* (2013.01)

(58) Field of Classification Search
CPC ..... B65D 2251/0093; B65D 2251/04; B65D 2251/1008; B65D 2401/15; B65D 2401/30
USPC ..... 220/258.4
See application file for complete search history.

(56) References Cited

U.S. PATENT DOCUMENTS

| | | | | |
|---|---|---|---|---|
| 2010/0288765 | A1* | 11/2010 | Herrbach | B65D 50/041 220/212 |
| 2013/0043260 | A1 | 2/2013 | Barron | |
| 2019/0071224 | A1 | 3/2019 | Berge | |
| 2021/0122532 | A1* | 4/2021 | Dreyer | B65D 41/3447 |
| 2023/0025075 | A1 | 1/2023 | Leuenberger et al. | |

FOREIGN PATENT DOCUMENTS

| | | | | |
|---|---|---|---|---|
| EP | 3689771 | A1 | 8/2020 | |
| EP | 3766797 | A1 * | 1/2021 | B65D 41/3423 |
| EP | 3798150 | A1 | 3/2021 | |
| ES | 1266291 | U * | 4/2021 | B65D 41/3428 |
| JP | H09-150846 | A | 6/1997 | |
| JP | 3704186 | B2 | 10/2005 | |
| WO | WO 2008/130250 | A1 | 10/2008 | |
| WO | WO 2011/090278 | A2 | 7/2011 | |
| WO | 2011138069 | A1 | 11/2011 | |
| WO | 2019207153 | A2 | 10/2019 | |
| WO | 2020160984 | A1 | 8/2020 | |
| WO | 2020163855 | A1 | 8/2020 | |
| WO | DM210087 | | 8/2020 | |
| WO | DM210099 | | 8/2020 | |
| WO | 2020193089 | A1 | 10/2020 | |
| WO | 2020193350 | A1 | 10/2020 | |
| WO | 2020212430 | A1 | 10/2020 | |
| WO | 2021001433 | A1 | 1/2021 | |
| WO | WO-2021013370 | A1 * | 1/2021 | B65D 55/16 |
| WO | WO-2021018772 | A1 * | 2/2021 | B65D 1/0246 |
| WO | 2021068058 | A1 | 4/2021 | |
| WO | WO-2021089103 | A1 * | 5/2021 | B65D 47/0838 |
| WO | 2021105176 | A1 | 6/2021 | |

OTHER PUBLICATIONS

"NPL_StackTeck" (attached). Screen captures from YouTube video clip entitled "2x24 Cavity Injection Stack Mold for round lids", uploaded on Oct. 19, 2018 by StackTeck. Retrieved from Internet : https://www.youtube.com/watch?v=GvPDeVQh4s0 (Year: 2018).*
English translation of ES 1266291 (Year: 2021).*
Extended European Search Report mailed Mar. 13, 2025 for European Application No. 22798446.5.

* cited by examiner

CLOSURE WITH RETAINING RING AND TAMPER EVIDENCE BAND

RELATED APPLICATIONS

This Application is a national stage filing under 35 U.S.C. 371 of International Patent Application Serial No. PCT/CA2022/050630, filed Apr. 25, 2022, which claims the benefit under 35 U.S.C. § 119(e) to U.S. Provisional Application Serial No. 63/184,297, filed May 5, 2021.

FIELD OF THE INVENTION

This invention relates generally to a closure and in particular to a closure for engaging the neck of a container. More specifically, although not exclusively, this invention relates to such closures which are made from molded plastics material for sealingly closing a carton package.

BACKGROUND OF THE INVENTION

Carton packages containing beverages and other fluids that incorporate a molded neck opening, and plastic closures that close such openings are well known. In recent years, it has become desirable to tether closures to their containers in order to avoid loss of the closure. Not only is this a matter of convenience, but it is also becoming a legal requirement in certain jurisdictions. Tethering of a closure to its container generally requires some means of attachment of the closure device to a retaining ring retained adjacent the open end of the container. Conventional closures generally incorporate a tamper evidence ring with frangible links to the main body of the closure, which are severed during first opening of the closure. The closure is normally removed from the open end of the container, while the tamper evidence ring is retained thereon. In such conventional closures, the tether generally connects the main body of the closure to the tamper evidence ring.

It is known to provide a neck and closure assembly for a carton package, which incorporates a cutter for piercing a foil membrane of the carton package. Such assemblies generally include a molded neck opening, a closure for covering the opening and a cutter mounted within the opening. The assembly is configured such that rotation of the closure causes the cutter to rotate and translate along the neck opening to pierce the foil. Typically, the closure includes a tamper evidence ring, as described above.

EP3798150A discloses a closure assembly including a lid, a tamper evidence ring and an endless coupling portion connecting the lid to the tamper evidence ring.

SUMMARY OF THE INVENTION

The present invention is directed, in particular but not exclusively, to a closure for sealingly closing a neck opening of a container, such as a carton package. The present invention is also directed to a closure assembly including the closure, as well as to mold stacks, molds and molding systems for, and methods of, molding such closures and closure assemblies.

Aspects of the invention provide a closure, which may have a retaining ring, e.g. for securement around the container neck. The closure may have a lid, e.g. for selectively closing an opening of the container neck. The lid may be pivotally connected to the retaining ring. The closure may have a tamper evidence band, which may be frangibly connected to the retaining ring. The tamper evidence band may be configured to be separated, in use, from the retaining ring, for example on first rotation or first opening of the closure relative to the neck.

According to a first broad aspect of the present invention, there is provided a closure for a container having a neck, the closure comprising a retaining ring for securement around the container neck, a lid pivotally connected to the retaining ring for selectively closing an opening of the container neck and a tamper evidence band frangibly connected to the retaining ring and configured to be separated, in use, from the retaining ring on first rotation or first opening of the closure relative to the neck.

The inventors have determined that the inclusion of a separate retaining ring and removable ring enables greater flexibility, for example to provide more effective tamper evidence.

The retaining ring may comprise an inwardly projecting retaining rim. The retaining rim may be continuous or discontinuous or segmented. The retaining ring may comprise one or more, e.g. a plurality of, retaining projections or cams. The retaining rim, projection(s) or cam(s) may be for engaging the annular flange of the container neck. The hinges may be connected to the retaining ring at substantially the same axial position as the retaining rim, projection(s) or cam(s). This enables the hinges to be extended for providing more freedom of movement to the lid as it is pivoted about the container neck.

The container neck may comprise an annular flange. The retaining ring may be for securement or secured, in use, around the container neck below the annular flange. The container neck may comprise at least one rotational stop. The tamper evidence band may have a rotational stop, which may be for engaging the rotational stop of the container neck, e.g. to separate, in use, the tamper evidence band from the retaining ring on first rotation of the closure relative to the neck. Severing the tamper evidence band on rotation of the closure severs the frangible connection earlier than relying on axial movement created by a threaded engagement between the lid and the container neck.

The lid may comprise a top wall. The lid may comprise a side wall, which may depend from the top wall. The lid may be pivotally connected to the retaining ring by at least one hinge, for example a pair of hinges which may be spaced. The side wall may comprise a void. The hinge(s) may be in the void of the side wall. The lid or side wall may comprise an engaging or securing feature, which may be on an inner surface of the side wall. The engaging or securing feature may be for engaging an external engaging or securing feature of the container neck. The engaging or securing feature(s) may comprise one or more threads or thread features. Alternatively, the engaging or securing feature(s) may comprise one or more snap fit features, for example one or more lips or flanges. The lip(s) or flange(s) may be extend along only part of the circumference of the lid or side wall.

The closure may comprise a tongue, which may be for holding or retaining the lid in an open position. The tongue may be thicker than the side wall or a nominal thickness thereof. The tongue may depend from the lid, for example from the top wall or from the side wall. The tongue may extend from the lid toward the retaining ring. The tongue may be in the void of the side wall and/or between the hinges. The tongue may be for engaging the container neck e.g. when the lid is pivoted to an open position.

Another broad aspect of the invention provides a closure for a container having a neck with an annular flange and at least one rotational stop, the closure comprising: a retaining ring for securement around the container neck below the annular flange: a lid for selectively closing an opening of the container neck, the lid comprising a top wall and a side wall depending from the top wall: a thread on an inner surface of the side wall for engaging an external thread of the container neck: a pair of spaced hinges in a void in the side wall of the lid, which pivotally connect the lid to the retaining ring: a tongue between the hinges, which depends from the lid for engaging the container neck when the lid is pivoted to an open position: and a tamper evidence band frangibly connected to the retaining ring and having a rotational stop for engaging the rotational stop of the container neck to separate, in use, the tamper evidence band from the retaining ring on first rotation of the closure relative to the neck.

The closure or lid may comprise one or more gripping features, such as one or more rib(s). At least part or some of the rib(s) may project from the side wall, for example an outer surface of the side wall. At least some of the rib(s) may extend along the side wall and/or axially or in an axial direction. At least part or some of the rib(s) may project from the top wall, for example an outer surface of the top wall. At least some of the rib(s) may extend along the top wall and/or radially or in a radial direction.

The side wall may comprise at least one edge rib, which may extend along the lower edge of the side wall. The edge rib(s) may extend along at least part of the lower edge of the side wall. The edge rib(s) may extend along all or substantially all of the lower edge of the side wall. The edge rib(s) may describe, delineate and/or extend across the void in the side wall. The edge rib(s) may comprise an axial edge rib portion, which may extend axially. The edge rib(s) may comprise a portion that extends along opposed edges describing or delineating the void. The opposed edges may extend axially or in an axial direction. The edge rib(s) may comprise a portion that extends along an edge joining the opposed edges. The edge rib(s) may comprise a substantially U-shaped portion describing or delineating the void.

The or each hinge may extend in an axial direction and/or may comprise an axial hinge. The or each hinge may be circumferentially aligned or substantially contiguous with the side wall of the lid. The or each hinge may have a radial thickness, which may be less than a radial thickness of the side wall. The radial thickness of the or each hinge may vary, for example the or each hinge may comprise a radially necked portion. In some embodiments the or each hinge comprises or is replaced by a respective leash.

The tongue may extend in an axial direction and/or may comprise an axial tongue. The tongue may be circumferentially aligned or substantially contiguous with the side wall of the lid.

The closure may comprise at least one leash, which may be configured to cause the tongue to engage the container neck. The leash(es) may comprise two or more leashes. The leash(es) may comprise a leash on each side of the tongue. The leash(es) may connect the lid to the retaining ring, e.g. for allowing the lid to be removed from the container neck while remaining attached to the retaining ring. The leash(es) may act, in use, as a torsion spring or torsion bar, for example when the lid is actuated to a fully open position, e.g. such that the tongue exerts a force against the container neck for retaining the lid in the fully open position.

Another aspect of the invention provides a closure for a container having a neck with an annular flange and at least one rotational stop, the closure comprising: a retaining ring for securement around the container neck below the annular flange: a lid for selectively closing an opening of the container neck, the lid comprising a top wall and a side wall depending from the top wall: a tongue depending from the top wall: a leash on each side of the tongue and connecting the lid to the retaining ring for allowing the lid to be removed from the container neck while remaining attached to the retaining ring: and a tamper evidence band frangibly connected to the retaining ring and having a rotational stop for engaging the rotational stop of the container neck to separate the tamper evidence band from the retaining ring on first rotation of the closure relative to the neck, wherein the leashes act, in use, as a torsion spring or torsion bar when the lid is actuated to a fully open position such that the tongue exerts a force against the container neck for retaining the lid in the fully open position.

The tongue may exert a force directly against the container neck, for example when the cap body is actuated to the fully open position. The tongue may exert a force on the container neck at a position between the annular flange and an open end of the container, for example when the lid is actuated to a fully open position.

The tongue may comprise a projecting lip, which may project radially. The projecting lip may define a contact surface, e.g. for contacting the container neck, for example when the lid is actuated to a fully open position. The projecting lip may be a first projecting lip. The tongue may further comprise a second projecting lip, which may also project radially. The first projecting lip and the second projecting lip may together describe or define the contact surface, e.g. for contacting the container neck, for example when the lid is actuated to a fully open position. The first projecting lip may be positioned at a free end of the tongue. The second projecting lip may be positioned at a root end of the tongue. The leash(es) may connect to the lid adjacent or in proximity to the root end of the tongue. The tongue may comprise a rib, which may project radially and/or may extend between the first and second projecting lips. The first projecting lip, the second projecting lip and the rib may together describe or define the contact surface, e.g. for contacting the container neck, in for example when the lid is actuated to a fully open position. The contact surface may be between the tongue and an exterior surface of the container neck, for example when the lid is actuated to a fully open position.

The retaining ring may comprise a lower edge, e.g. to which the tamper evidence band may be frangibly connected. The retaining ring may comprise an upper edge, which may be opposite the lid, for example the side wall of the lid, e.g. the lower edge of the side wall. The retaining ring or its upper edge may, but need not, be frangibly connected to the lid, for example the side wall of the lid, e.g. the lower edge of the side wall. The retaining ring may comprise an annulus and/or have a constant or substantially constant height. The height of the retaining ring may be described between upper and lower edges thereof.

The leash(es), if present, may be frangibly connected to the retaining ring and/or to the lid, e.g. the side wall thereof or the lower edge of the side wall. At least part of the leash(es) may be described, defined or delineated in the retaining ring, for example by one or more cut lines. The leash(es) may have lower edges, which may be described or delineated or defined by the cut line(s). The leash(es) may be frangibly connected to the retaining ring, e.g. the rest of the retaining ring, along the lower edges or along edges that describe, define or delineate them in the retaining ring, e.g. along the cut line(s). The leash(es) may comprise an upper edge, which may correspond to and/or be contiguous with the upper edge of the retaining ring. The upper edge of the leash(es) may be frangibly connected to the lid, e.g. the side wall thereof or the lower edge of the side wall.

The frangible connection between the retaining ring and the lid may be more fragile than the frangible connection between the retaining ring and the tamper evidence band. The frangible connection between the leash(es) and the retaining ring may be more fragile than the frangible connection between the retaining ring and the tamper evidence band. The frangible connection between the leash(es) and the lid may be more fragile than the frangible connection between the retaining ring and the tamper evidence band. The or each frangible connections may be more fragile than the leash(es).

The lid, e.g. the side wall thereof, may comprise at least one relief, e.g. to inhibit interference between the lid or sidewall and the container neck as the lid is pivoted toward an open position. The at least one relief may be adjacent and/or extend from the void in the side wall. The at least one relief may be included or incorporated in the void. The void may comprise at least one flank or chamfer, which may describe, delineate or define the relief. The void may comprise a pair of flanks or chamfers, e.g. on each of its sides, which may describe the relief.

The leash(es) may undergo twisting as the lid moves from a closed position to an open position, e.g. a fully open position. At least one or each leash may comprise a kink or dogleg. At least one or each leash may comprise first and second portions. The first and second portions may be positioned at an angle in relation to each other, for example when the closure device is in a fully closed position. The or each first portion may depend from the lid. The first portions may diverge from one another, e.g. at an oblique, right or obtuse angle.

The first portion may extend along at least part of the relief. The first portion may extend along the flank or chamfer of the void. In some examples, the first portion of each leash extends along a respective relief or a respective flank or chamfer of the void. The second portion may extend from the first portion and/or circumferentially and/or along a circumferential portion of the lower edge of the side wall. The second portion of the leash(es) may be formed within the retaining ring.

The leash(s) may be sized to allow the lid to be removed from the neck of the container. The lid may be positionable at an angle of 90° to 180° in relation to the container, for example when in the fully open position. The lid may be retained in a closed position on the container by means of a threaded interface with the neck. The lid may be configured to be actuated from a fully open position back to a closed configuration and be retained in the closed configuration via the threaded interface.

The closure may comprise a locking tab, which may project from the retaining ring and/or toward the lid or the top wall thereof. The locking tab may be between the hinges. The tongue may engage, in use, the locking tab, for example when the lid is pivoted in an open position. The locking tab may comprise a recess. The or a further tongue may project radially from the lid, e.g. for engaging the locking tab or the recess therein, for example when the lid is pivoted to an open position.

Another aspect of the invention provides a closure for a container having a neck with an annular flange and at least one rotational stop, the closure comprising: a retaining ring for securement around the container neck below the annular flange: a lid for selectively closing an opening of the container neck, the lid comprising a top wall and a side wall depending from the top wall: a pair of spaced hinges in a void in the side wall of the lid, which pivotally connect the lid to the retaining ring: a locking tab between the hinges, which projects from the retaining ring toward the top wall of the lid: and a tongue between the hinges, which projects radially from the lid for engaging a recess in the locking tab when the lid is pivoted to an open position: and a tamper evidence band frangibly connected to the retaining ring and having a rotational stop for engaging the rotational stop of the container neck to separate, in use, the tamper evidence band from the retaining ring on first rotation of the closure relative to the neck.

The lid may comprise a grip tab, which may project, e.g. radially, from its outer surface. The grip tab may project from the side wall, for example at or adjacent its lower edge. The grip tab may be substantially aligned with, adjacent to or below, e.g. slightly below; the snap fit feature on the inner surface of the side wall.

The retaining ring may comprise a locating feature, for example on or in an inner surface thereof, e.g. an inner surface thereof. The locating feature may be for engaging a locating feature of the container neck. The locating feature of the retaining ring may comprise a projection and/or a recess. The locating feature of the retaining ring may comprise a tapered surface, which may face the top wall and/or comprise an uppermost surface of thereof. The locating feature may be adjacent the lower edge of the retaining ring. The locating feature may be circumferentially aligned with the void of the side wall and/or with the locking tab and/or with the tongue and/or between the hinges. The locating feature of the retaining ring may comprise or provide a rotational stop, e.g. for orienting the closure in a predetermined position relative to the neck or container. The locating feature of one of the retaining ring and the container neck may comprise a pair of locating features, e.g. between which the locating feature of the other of the retaining ring and the container neck may be captivated, in use, when the closure is rotated to the predetermined position relative to the neck or container.

At least one of the frangible connections may comprise one or more, e.g. a plurality of, bridges. The bridges may be spaced or disposed evenly about the circumference of the closure. The bridges may comprise frangible bridges that may have a necked region or a region of weakness.

Another broad aspect of the invention provides a closure assembly comprising a closure, e.g. as described above. The assembly may comprise a container neck, e.g. to which the closure is secured or securable. The assembly may comprise a cutter, e.g. received or receivable within the container neck.

The container neck may comprise one or more internal threads or thread features. The cutter may comprise one or more external threads or thread features. The closure may comprise one or more tabs or coupling features, which may depend from the lid, e.g. the top wall of the lid. The cutter may comprise one or more stops, e.g. for cooperating with the tab(s) or coupling feature(s) of the closure. The cutter may comprise a sharp and/or serrated edge, e.g. lower edge. The assembly may be configured such that rotation, in use, of the closure causes the cutter to rotate therewith. Rotation of the cutter may cause the cutter to engage the container neck, e.g. via the thread(s) or thread feature(s), and/or may cause the cutter to translate along the container neck. Translation and/or rotation of the cutter may cause the cutter, e.g. the sharp and/or serrated edge thereof, to pierce and/or cut through a membrane of the container.

The container neck may comprise one or more external engaging or securing features, e.g. for cooperating with one or more internal engaging or securing feature(s) of the closure or the lid or side wall of the lid of the closure. The external engaging or securing feature(s) of the container neck may comprise one or more threads or thread features. The internal engaging or securing feature(s) of the closure may comprise one or more threads or thread features. The closure may threadedly engage the container neck.

Alternatively, the external engaging or securing feature(s) of the container neck may comprise one or more snap fit features, rims, lips or flanges, which may be annular, circumferential or circumferentially continuous. The internal engaging or securing feature(s) of the closure may comprise one or more snap fit features, lips or flanges, which may extend along only part of the circumference of the lid or side wall. The closure may comprise a snap fit engagement with the container neck.

The container neck may further comprise a rim, lip or flange, e.g. an annular, circumferential or circumferentially continuous rim, lip or flange, positioned to engage the retaining rim, projection(s) or cam(s) of the retaining ring of the closure. The rim, lip or flange, positioned to engage the retaining ring of the closure may be below the external engaging or securing feature(s).

The container neck may further comprise at least one rotational stop, e.g. for engaging the rotational stop of the tamper evidence band, e.g. to separate, in use, the tamper evidence band from the retaining ring on first rotation of the closure relative to the neck. The container neck may, but need not, comprise a further rim, lip or flange, e.g. an annular, circumferential or circumferentially continuous rim, lip or flange, positioned above the at least one rotational stop and/or below the rim, lip or flange positioned to engage the retaining rim, projection(s) or cam(s) of the retaining ring of the closure. The further rim, lip or flange may be positioned between the at least one rotational stop and the rim, lip or flange positioned to engage the retaining rim, projection(s) or cam(s) of the retaining ring of the closure. The further rim, lip or flange may be for engaging the rotational stop of the tamper evidence band, e.g. to inhibit its removal from the container neck.

The at least one rotational stop may comprise a plurality of rotational stops spaced about the circumference of the container neck, e.g. on or in an external surface thereof. The tamper evidence band may comprise a corresponding plurality of rotational stops spaced about its circumference, e.g. on or in an internal surface thereof. The at least one rotational stop of the container neck may comprise a radial projection and/or a radial recess. The at least one rotational stop of the tamper evidence band may comprise a corresponding radial recess projection and/or a radial projection.

The or each rotational stop of the tamper evidence band may comprise a radially sloped surface, e.g. on a first side thereof. The radially sloped surface of the or each rotational stop of the tamper evidence band may be configured to engage the or each rotational stop of the container neck. The radially sloped surface(s) may enable the closure to be rotated in a first direction, e.g. to mount or screw the closure onto the container neck without severing the tamper evidence band. The or each rotational stop of the container neck may, but need not, comprise a radially sloped surface, e.g. on a first side thereof.

The or each rotational stop of the container neck may comprise a radial surface, e.g. on a second side thereof, which may be opposite the first side. The radial surface(s) may prevent rotation of the tamper evidence band relative to the container neck, e.g. in a second direction which may be opposite the first direction. The second direction of rotation may correspond to an unscrewing direction, e.g. for removing the lid of the closure from the container neck. The or each rotational stop of the tamper evidence band may comprise a radial surface, e.g. on a second side thereof, which may be opposite the first side. The radial surface of the or each rotational stop of the tamper evidence band may be configured to engage the radial surface of the or each rotational stop of the container neck.

The container neck may comprise a locating feature, for example on or in an external surface thereof. The locating feature may be for engaging the locating feature of the retaining ring. The locating feature of the container neck may comprise a projection and/or a recess. The locating feature of the container neck may comprise a tapered surface, which may face the top wall and/or comprise an uppermost surface of thereof. The locating feature may be between, e.g. axially between, the external engaging or securing feature(s) and the one or more rotational stops.

The container neck may comprise a mounting flange for mounting the container neck to a carton.

Another aspect of the invention provides a package comprising a container and the aforementioned closure or closure assembly. The container may comprise a carton.

Another aspect of the invention provides a mold stack describing the aforementioned closure.

The mold stack may comprise any one or more features that correspond to those described above in relation to the closure.

The mold stack may comprise a core or core assembly, which may describe one or more inner surfaces of the closure, e.g. inner surfaces of the top wall and/or of the side wall and/or of the shell.

The mold stack may comprise a cavity or cavity assembly, which may describe one or more outer surfaces of the closure, e.g. outer surfaces of the top wall and/or of the side wall and/or of the shell. The cavity assembly may comprise a gate pad and/or a gate insert, which may together describe at least part of the top wall, e.g. a top and/or radial outer part thereof. The slides may describe one or more outer surfaces of the closure, e.g. outer surfaces of the top wall and/or of the side wall and/or of the shell.

The mold stack may comprise one or more, e.g. a pair of, slide(s), which may describe an outer surface of at least part of the lid and/or of the shell.

The slide(s) may describe an outer surface of at least part of the top wall, for example a lower and/or radial outer part thereof. The slide(s) may describe an outer surface of at least part of the side wall. The slide(s) may describe an outer surface of at least part of the retaining ring.

Another aspect of the invention provides a mold. The mold may comprise at least one molding cavity for molding a closure, e.g. as described above. The mold may comprise at least one mold stack, e.g. as described above.

Another aspect of the invention provides a molding system. The molding system may comprise at least one molding cavity for molding a closure, e.g. as described above. The molding system may comprise at least one mold stack, e.g. as described above. The molding system may comprise a mold as described above.

Another aspect of the invention provides a computer program element comprising and/or describing and/or defining a three-dimensional design, e.g. of the closure, mold stack, core or cavity described above or an embodiment thereof. The three-dimensional design may be for use with a simulation means or an additive or subtractive manufacturing means, system or device.

The computer program element may be for causing, or operable or configured to cause, an additive or subtractive manufacturing means, system or device to manufacture the closure, mold stack, core or cavity described above or an embodiment thereof.

The computer program element may comprise computer readable program code means for causing an additive or subtractive manufacturing means, system or device to execute a procedure to manufacture the closure, mold stack, core or cavity described above or an embodiment thereof.

A further aspect of the invention provides a computer program element comprising computer readable program code means for causing a processor to execute a procedure to implement one or more steps of the aforementioned method.

A yet further aspect of the invention provides the computer program element embodied on a computer readable medium.

For the avoidance of doubt, any of the features described herein apply equally to any aspect of the invention. Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible.

For the avoidance of doubt, the terms "may", "and/or", "e.g.", "for example" and any similar term as used herein should be interpreted as non-limiting such that any feature so-described need not be present. Indeed, any combination of optional features is expressly envisaged without departing from the scope of the invention, whether or not these are expressly claimed. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Embodiments of the invention will now be described by way of example only with reference to the accompanying drawings in which.

DETAILED DESCRIPTION OF THE INVENTION

Figure 1:
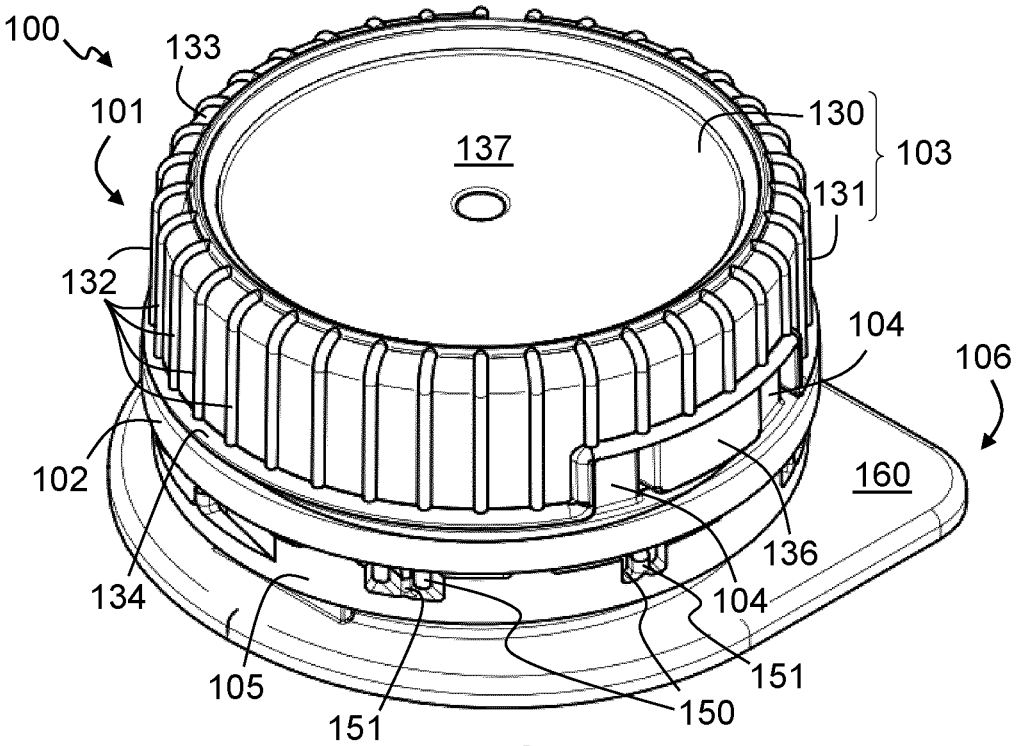
FIG. 1 is a perspective view of a closure assembly according to a first example.
Figure 2:
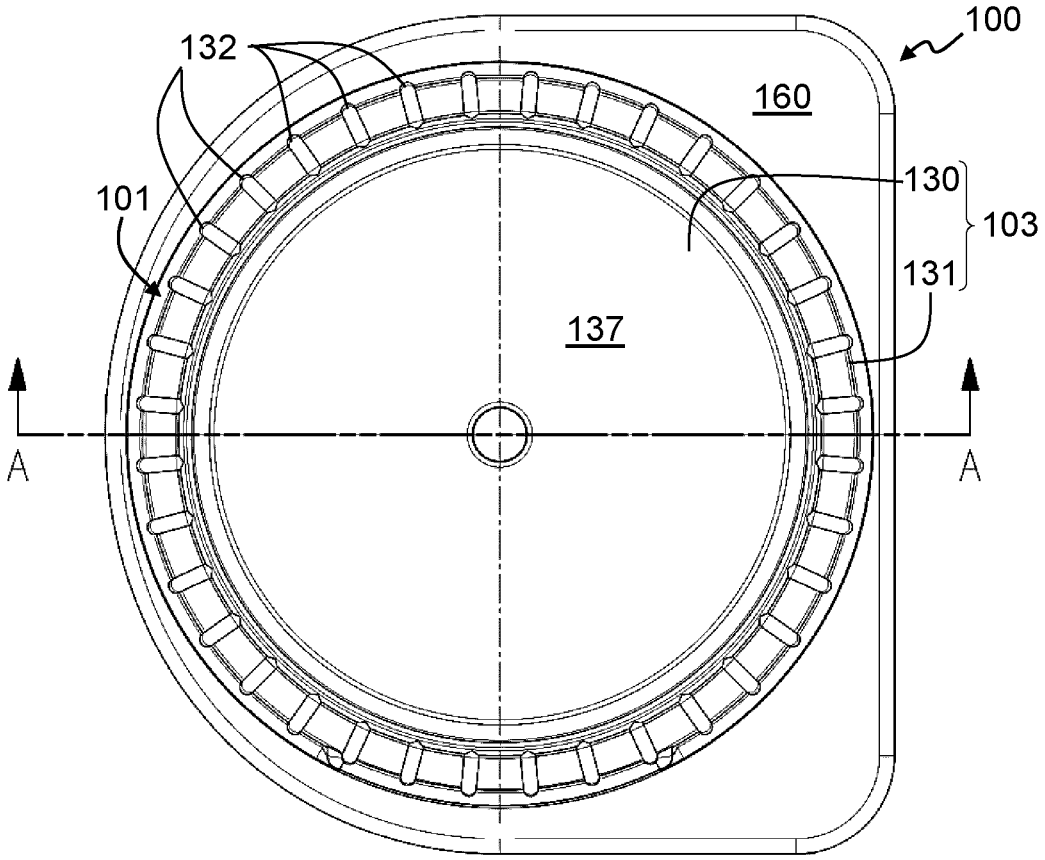
FIG. 2 is a top view of the closure assembly of FIG. 1.
Figure 3:
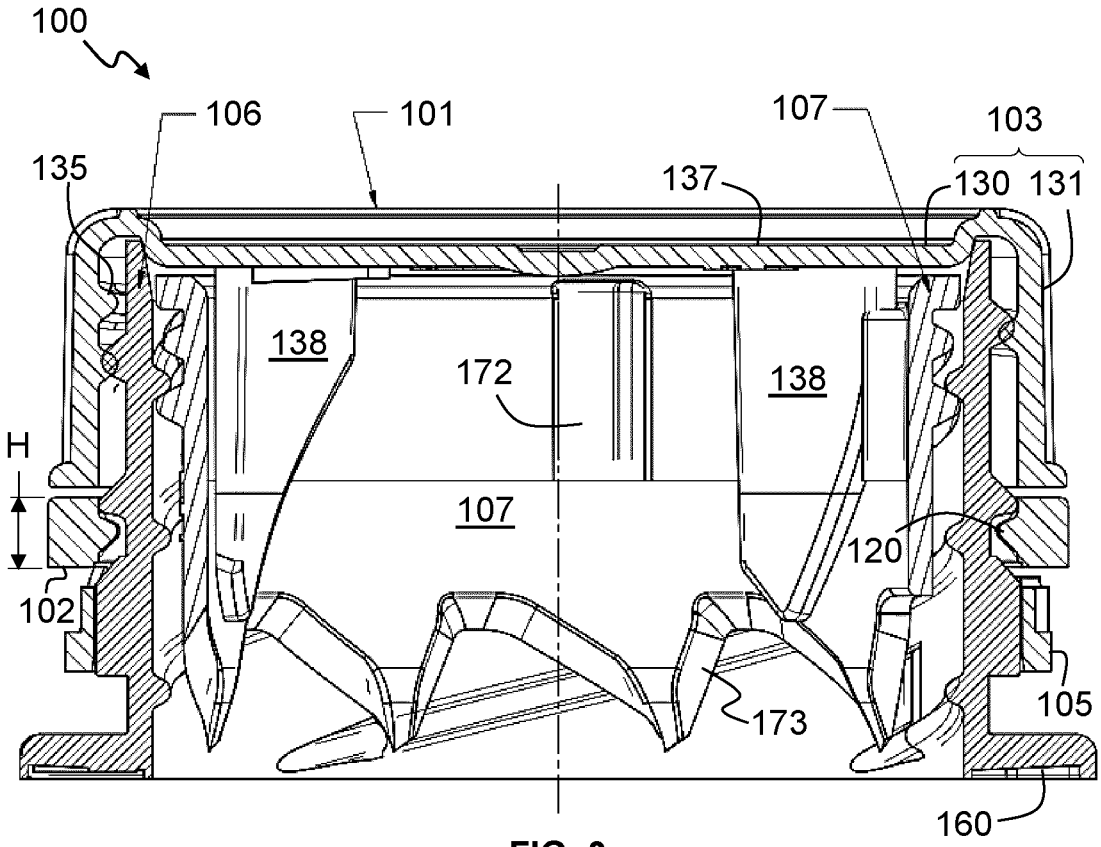
FIG. 3 is a section view of the closure assembly along line A-A of FIG. 2.

With reference to FIGS. 1 to 3, there is depicted a closure assembly 100 for a carton (not shown), which includes a closure 101 having a retaining ring 102, a lid 103 pivotally connected to the retaining ring 102 by a pair of spaced hinges 104 and a tamper evidence band 105 frangibly connected to the retaining ring 102. The closure 101 is mounted to a container neck 106 and rotationally engages a cutter 107 received within the container neck 106.

The retaining ring 102 in this example is a narrow band having a substantially constant height H described between an upper edge, to which the lid 103 is pivotally connected, and a lower edge, to which the tamper evidence band 105 is frangibly secured. The retaining ring 102 includes a plurality of retaining cams 120 projecting internally and spaced about its circumference.

The lid 103 includes a top wall 130, a side wall 131 depending from the periphery of the top wall 130 and gripping ribs 132 extending axially along the external surface of the side wall 131 and radially along a curved transition 133 between the side wall 131 and the top wall 130. The side wall 131 includes a void within which the hinges 104 are located. The lid 103 also includes an edge rib 134 extending about the entire lower edge of the side wall 131, including the edges describing the void, thereby reinforcing the region connecting the lid 103 to the hinges 104.

The side wall 131 includes an internal thread 135 projecting from an inner surface thereof. The side wall 131 also includes a tongue 136 depending from an upper edge of the void toward the retaining ring 102. The tongue 136 is thicker than the side wall 131 to give it rigidity. The hinges 104 extend from the upper edge of the void and join the upper edge of the retaining ring 102. The hinges 104 are thinner than the side wall 131, in order to provide them with the requisite flexibility to open the closure 101. Although not present in this example, the side wall 131 may be frangibly connected to the retaining ring 102 by a series of bridges (not shown).

The top wall 130 includes a depression 137, which creates a sealing rim that seals against the container neck 106, as shown more clearly in FIG. 3. Part-cylindrical tabs 138 depend from the top wall 130 for engaging the cutter 107.

Figure 4:
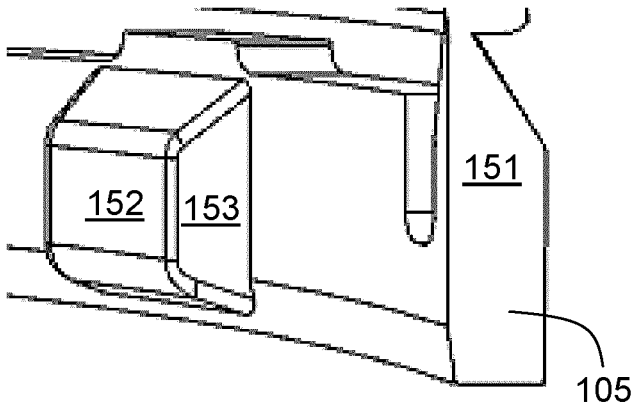
FIG. 4 is an enlarged view of a rotational stop of the tamper evident band of the closure of the closure assembly of FIGS. 1 to 3.

The tamper evidence band 105 also has a substantially constant height, but with a series of pockets 150 within which a respective bridge 151 is formed. Each bridge 151 is a narrow band of material that frangibly joins the tamper evidence band 105 to the retaining ring 102. Each bridge 151 tapers toward its connection with the retaining ring 102, as illustrated more clearly in FIG. 4. The tamper evidence band 105 also includes a plurality of rotational stops 152 projecting from its inner surface, which is also shown in FIG. 4. Each rotational stop 152 includes a radially sloped surface 153 on one side, but the surface on its opposite side lies on a radial plane to provide the rotational stop surface (not shown).

Figure 5:
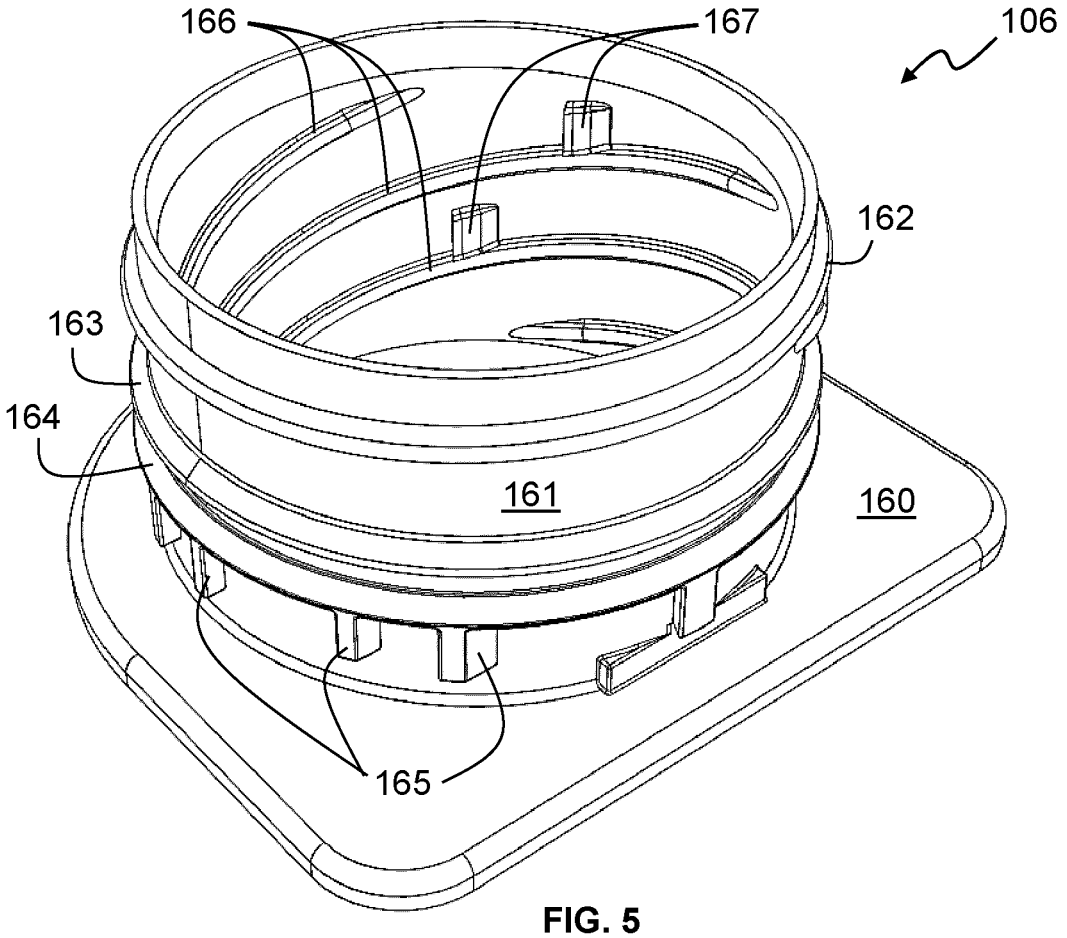
FIG. 5 is a perspective view of the container neck of the closure assembly of FIGS. 1 to 3.

The container neck 106, shown more clearly in FIG. 5, includes a mounting flange 160 for mounting the container neck 106 to a carton (not shown) and a hollow cylindrical neck portion 161 projecting from the mounting flange 160. The neck portion 161 includes an external thread 162 for cooperating with the internal thread 135 of the side wall 131 of the lid 103 of the closure 101.

The neck portion 161 also includes a retaining flange 163 projecting radially below the external thread 162, a tamper evidence flange 164 projecting radially below the retaining flange 163 and a series of stops 165 depending from the tamper evidence flange 164 and projecting outwardly. The neck portion 161 also includes a series of internal threads 166 and a series of internal stops 167 projecting upwardly from the internal threads 166 and inwardly from the neck portion 161. The internal threads 166 are threaded in the opposite direction to the external thread 162 and have a much steeper helix angle.

Figure 6:
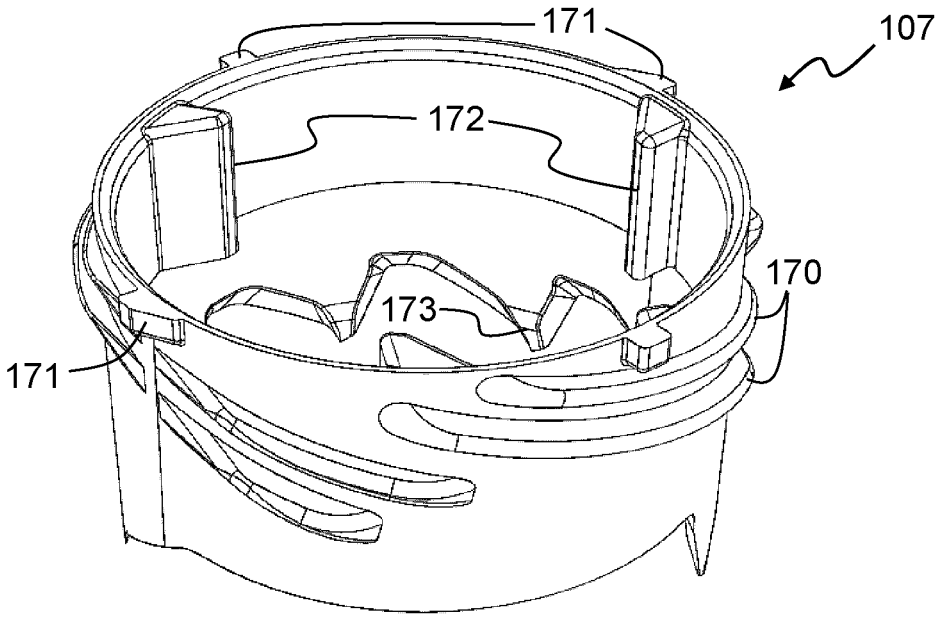
FIG. 6 is a perspective view of the cutter of the closure assembly of FIGS. 1 to 3.
Figure 7:
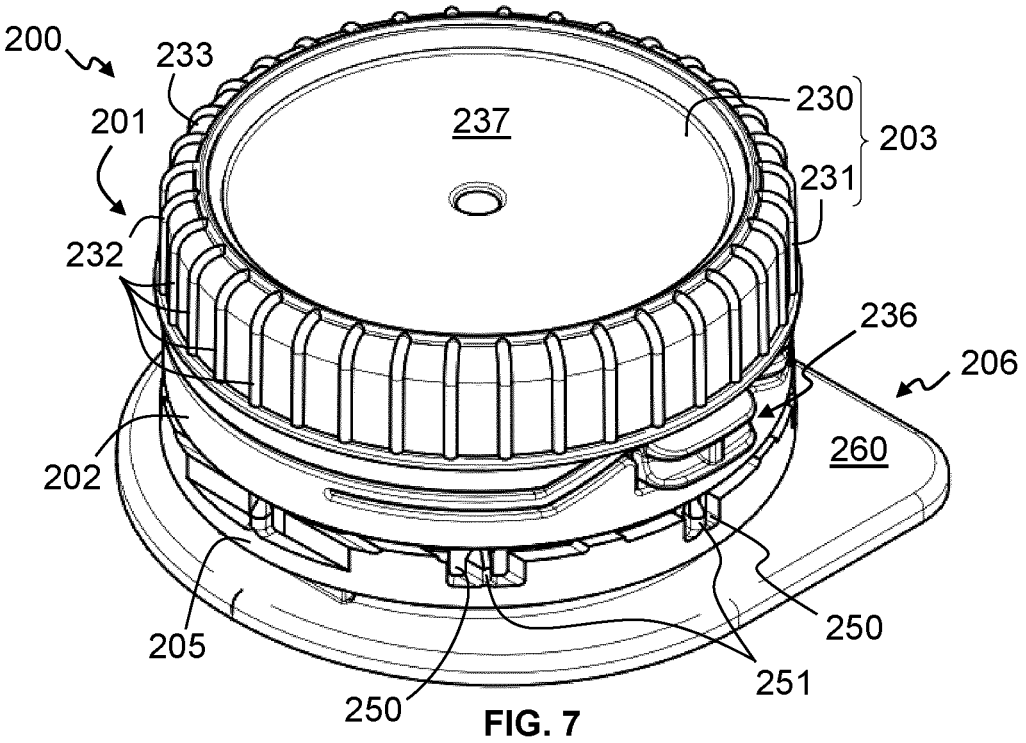
FIG. 7 is a perspective view of a closure assembly according to a second example.
Figure 8:
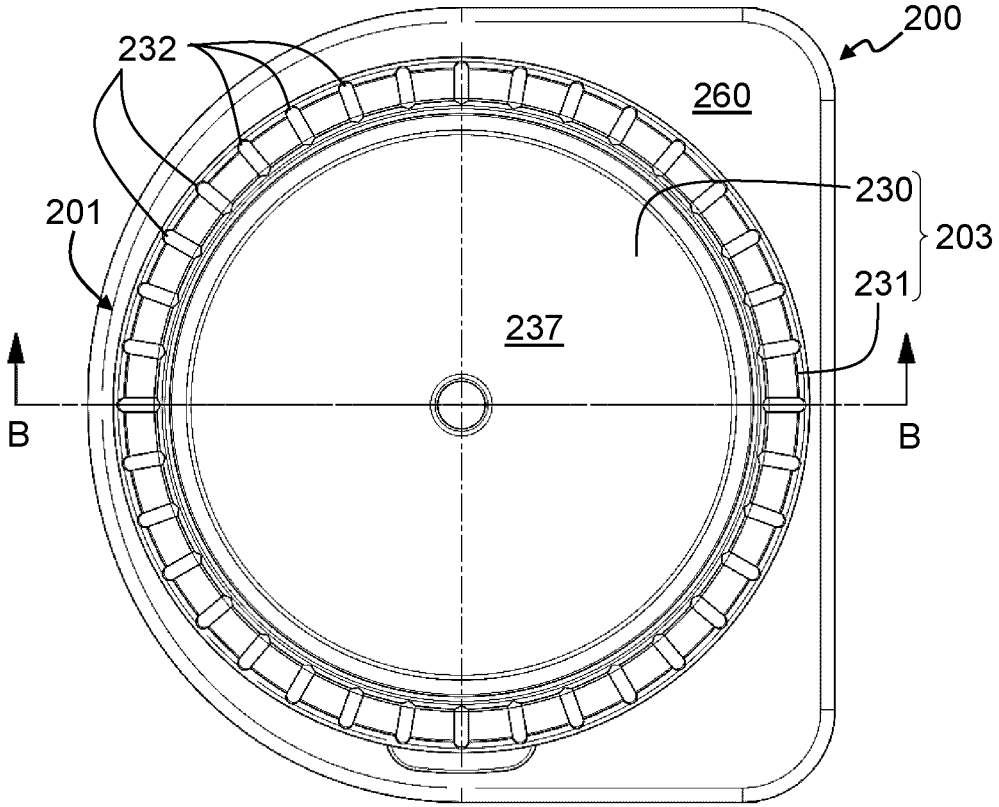
FIG. 8 is a top view of the closure assembly of FIG. 7.

The cutter 107, shown more clearly in FIG. 6, is hollow and substantially cylindrical, with external threads 170 and external stops 171 projecting outwardly and spaced about its upper edge. The external threads 170 of the cutter 107 cooperate with the internal threads 166 of the container neck 106, while the external stops 171 of the cutter 107 cooperate with the internal stops 167 of the container neck 106 to prevent the cutter 107 from being retracting out of the container neck 106.

The cutter 107 also includes a series of internal stops 172, for cooperating with the tabs 138 depending from the top wall 130 of the lid 103 the closure 101, and a serrated lower edge 173 for piercing a foil of the container (not shown).

In use, the cutter 107 is received within the container neck 106 such that their threads 166, 170 are engaged with one another, but such that the cutter 107 is in an uppermost, retracted position. The closure 101 is mounted to the container neck 106 such that the external thread 162 of the neck portion 161 engages the internal thread 135 of the side wall 131 of the lid 103 of the closure 101, as illustrated in FIG. 3. The closure 101 is then forced onto the container neck 106 by an axial force, such that the internal thread 135 of the closure 101 is forced over the external thread 162 of the neck portion 161.

When the closure 101 is rotated in an unscrewing direction, the rotational stops 152 of the tamper evidence band 105 engage the stops 165 of the container neck 106 and break the bridges 151, thereby breaking or severing the frangible connection between the tamper evidence band 105 and the retaining ring 102. Continued rotation of the closure 101 causes the tabs 138 depending from the top wall 130 of the lid 103 the closure 101 to engage the internal stops 172 of the cutter 107, thereby driving rotation of the cutter 107. As the cutter 107 rotates, the external threads 170 of the cutter 107 cooperate with the internal threads 166 of the container neck 106 to cause the cutter 107 to translate downwardly along the container neck 106. This rotation and downward translation of the cutter 107 causes the serrated lower edge 173 to engage and cut a hole through a foil (not shown) sealing the carton (not shown) to which the container neck 106 is attached.

When the closure 101 is unscrewed fully, the lid 103 may be pivoted about the hinges 104 to reveal the opening of the container neck 106. The resilience of the hinges 104 urges the tongue 136 against the container neck 106, such that it engages the external thread 162 of the neck portion 161 and retains the lid 103 in an open position. The thickness of the tongue 136 ensures that the lid 103 is retained in this orientation.

Referring now to FIGS. 7 to 11, there is depicted a closure assembly 200 for a carton (not shown), similar to the closure assembly 100 according to the first example, wherein like references depicting like features are incremented by 100. Whilst the closure 201 in this example also has a retaining ring 202 and a lid 203 pivotally connected to the retaining ring 202, the spaced hinges 104 are replaced with a pair of leashes 204. The closure 201 also includes a tamper evidence band 205 frangibly connected to the retaining ring 202. The closure 201 is mounted to a container neck 206, which is identical to the container neck 106 according to the first example and will therefore not be described further. Similarly, the closure 201 rotationally engages a cutter 207, which is received within the container neck 206, and the cutter 207 is identical to the cutter 107 of the first example and will therefore not be described further.

The retaining ring 202 in this example is also a narrow band with a height H described between an upper edge and a lower edge. The upper edge of the retaining ring 202 in this example is frangibly connected to the lid 203, as well as being connected thereto by the leashes 204. As with the first example, the lower edge of the retaining ring 202 is frangibly connected to the tamper evidence band 205. The retaining ring 202 also includes a plurality of retaining cams 220 projecting internally and spaced about its circumference. As illustrated more clearly in FIG. 12, each retaining cam 220 has a substantially U-shape, with an upper ledge and a pair of lead-in ramps at each end of the upper ledge.

The lid 203 includes a top wall 230, a side wall 231 depending from the periphery of the top wall 230 and gripping ribs 232 extending axially along the external surface of the side wall and radially along a curved transition 233 between the side wall 231 and the top wall 230. The side wall 231 includes a trapezoidal void within which part of the leashes 204 extend, which describes a relief on each of its sides for providing clearance between the side wall 231 and the container neck 206 as it pivots to an open position. The lid 203 is frangibly connected to the retaining ring 202 by a plurality of bridges 234 spaced about the lower edge of the side wall 231 and to each leash 204 by a single bridge 234*a*.

The side wall 231 includes an internal thread 235 and a tongue 236 depending from an upper edge of the void toward the retaining ring 202. The retaining ring 202 also includes a pair of triangular tabs 221 projecting upwardly from its upper edge, on either side of the tongue 236, and into the void in the side wall 231. The tongue 236 includes upper and lower projecting lips 236*a*, 236*b* and a rib 236*c* extending between and joining a respective central portion of the projecting lips 236*a*, 236*b*. The projecting lips 236*a*, 236*b* and rib 236*c* increase the effective thickness of the tongue 236 and together describe a contact surface between the tongue 236 and an exterior surface of the container neck 206 when the lid 203 is actuated to a fully open position.

Each leash 204 is connected to the lid 203 on a respective side of the tongue 236 at an upper edge of the void in the side wall 231. Each leash 204 includes first and second portion 241, 242 extending at an angle relative to one another, substantially in the shape of a dogleg. The first portions 241 depend from the lid 203 and diverge from one another along the upper edge of the tabs 221 of the retaining ring 202. Each second portion 242 is connected at a first of its ends to the first portion 241, extends along the retaining ring 202 and is connected to the retaining ring 202 at a second of its ends. In this example, each second portion is frangibly connected to the side wall 231 of the lid 203 by a single bridge 234*a*. Each second portion 242 is formed within the retaining ring 202 and may, but need not, be frangibly connected thereto.

Figure 9:
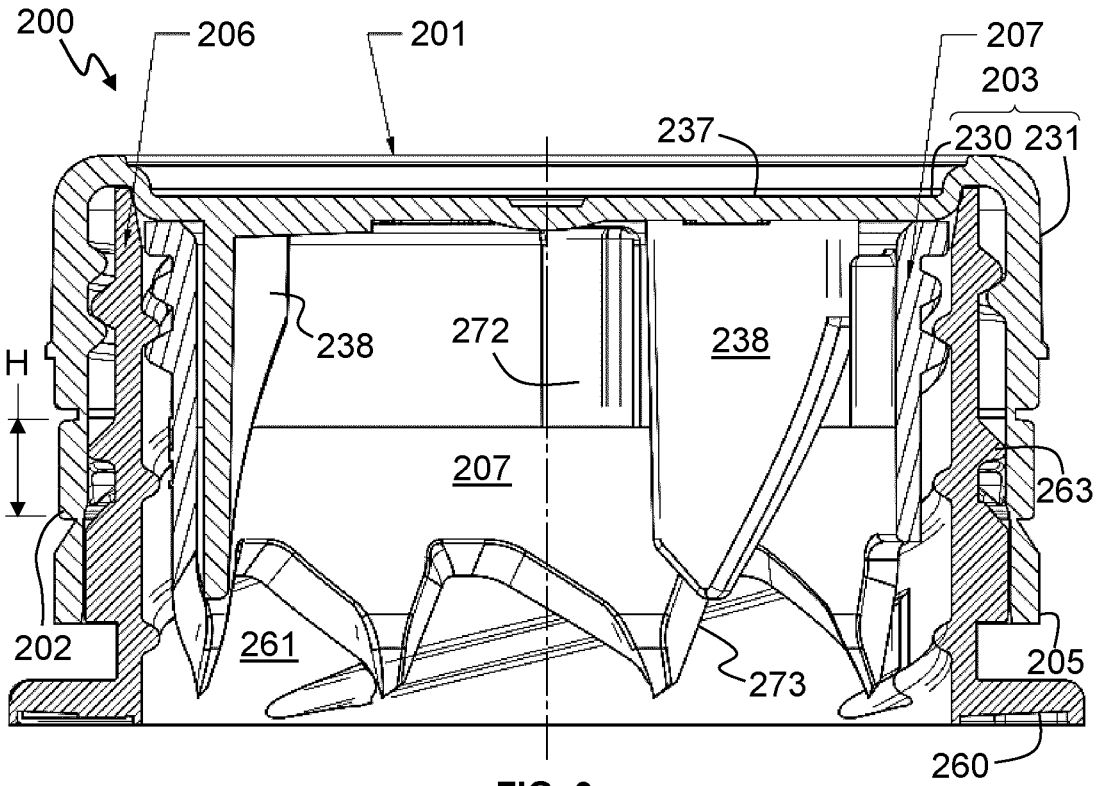
FIG. 9 is a section view of the closure assembly along line B-B of FIG. 8.
Figure 10:
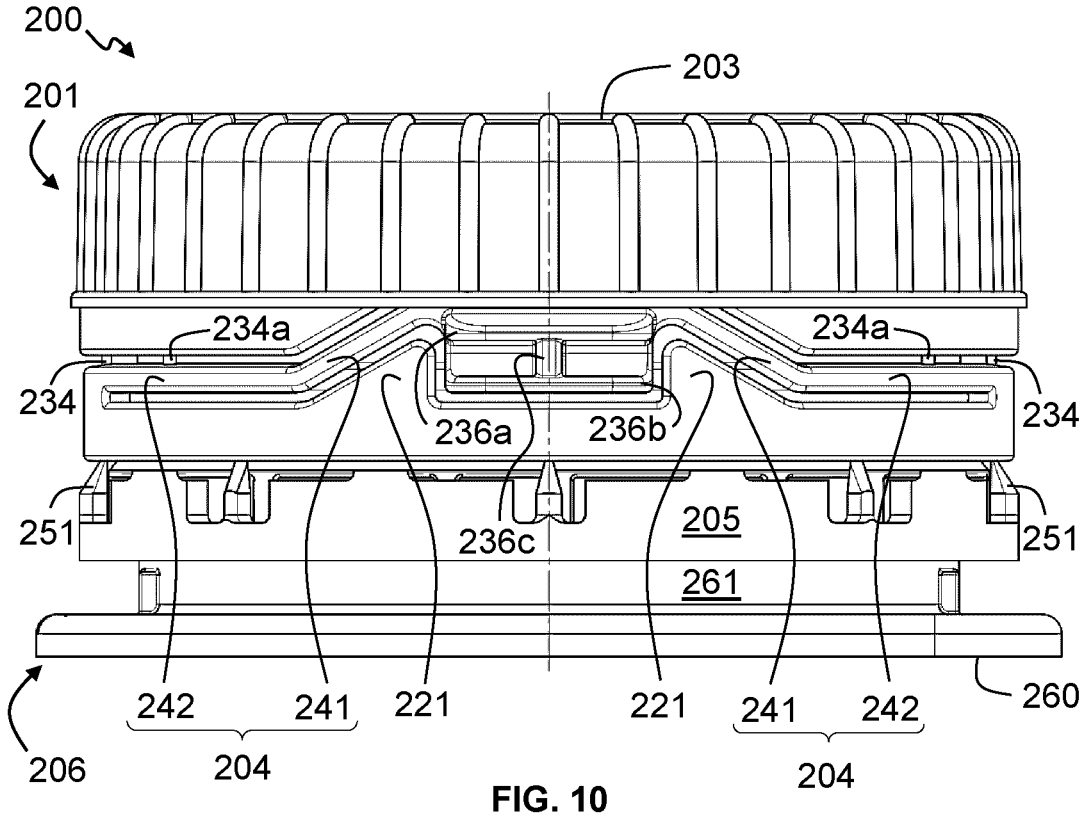
FIG. 10 is a rear view of the closure assembly of FIGS. 7 to 9.

The top wall 230 includes a depression 237, which creates a sealing rim that seals against the container neck 206, as shown more clearly in FIG. 9. The lid 203 also includes part-cylindrical tabs 238 depending from the top wall 230 for engaging the cutter 207.

Figure 11:
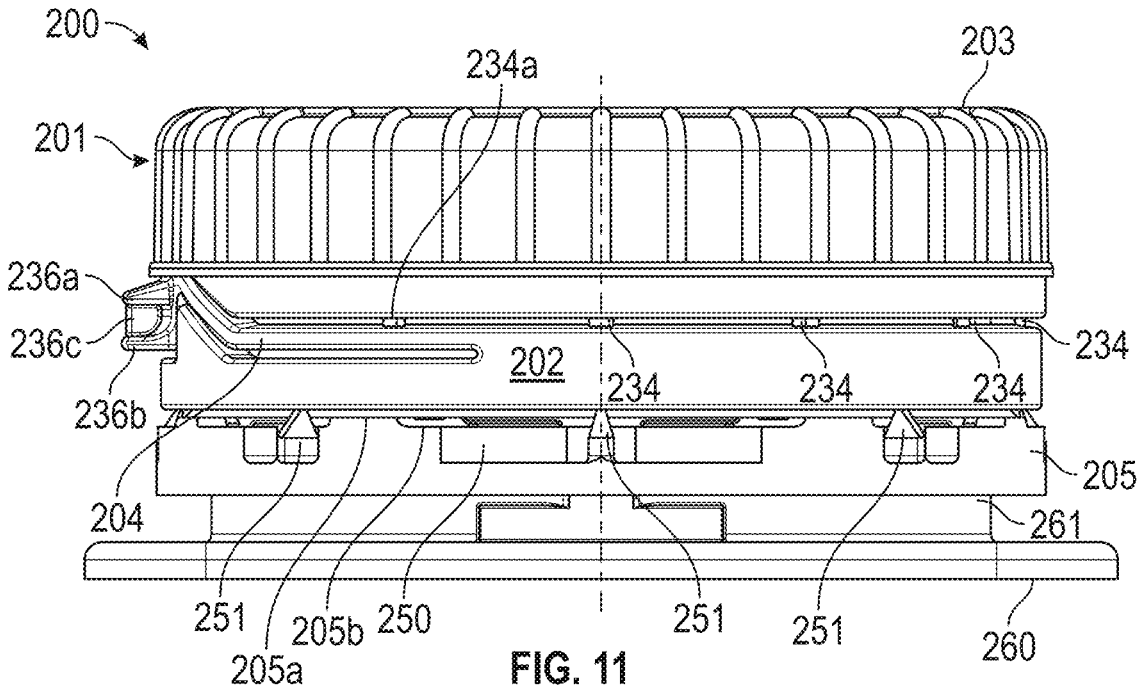
FIG. 11 is a side view of the closure assembly of FIGS. 7 to 10.
Figure 12:
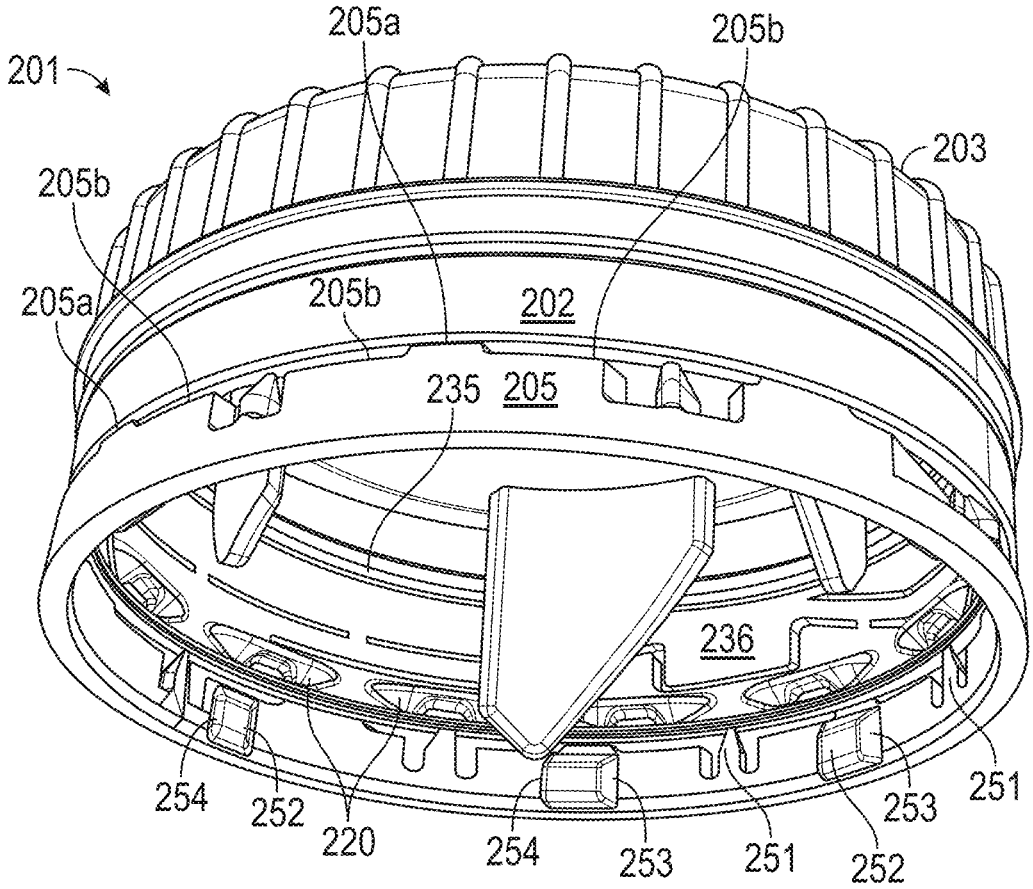
FIG. 12 is a perspective view of the closure of the closure assembly of FIGS. 7 to 11 from below.
Figure 13:
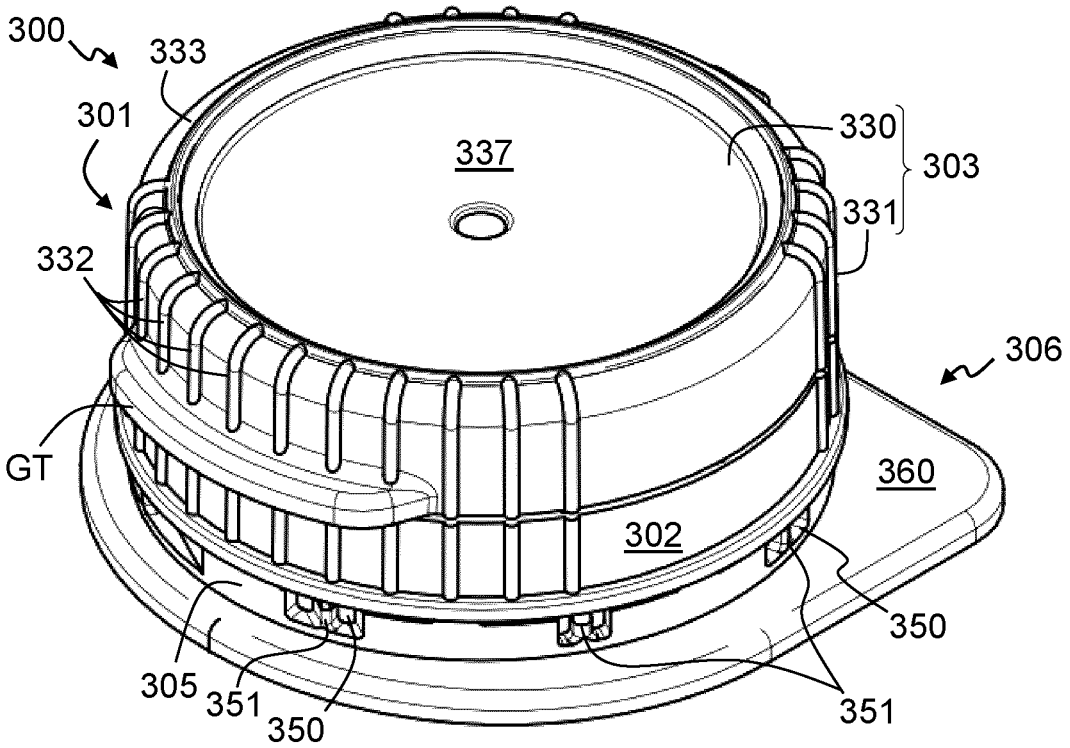
FIG. 13 is a perspective view of a closure assembly according to a third example.
Figure 14:
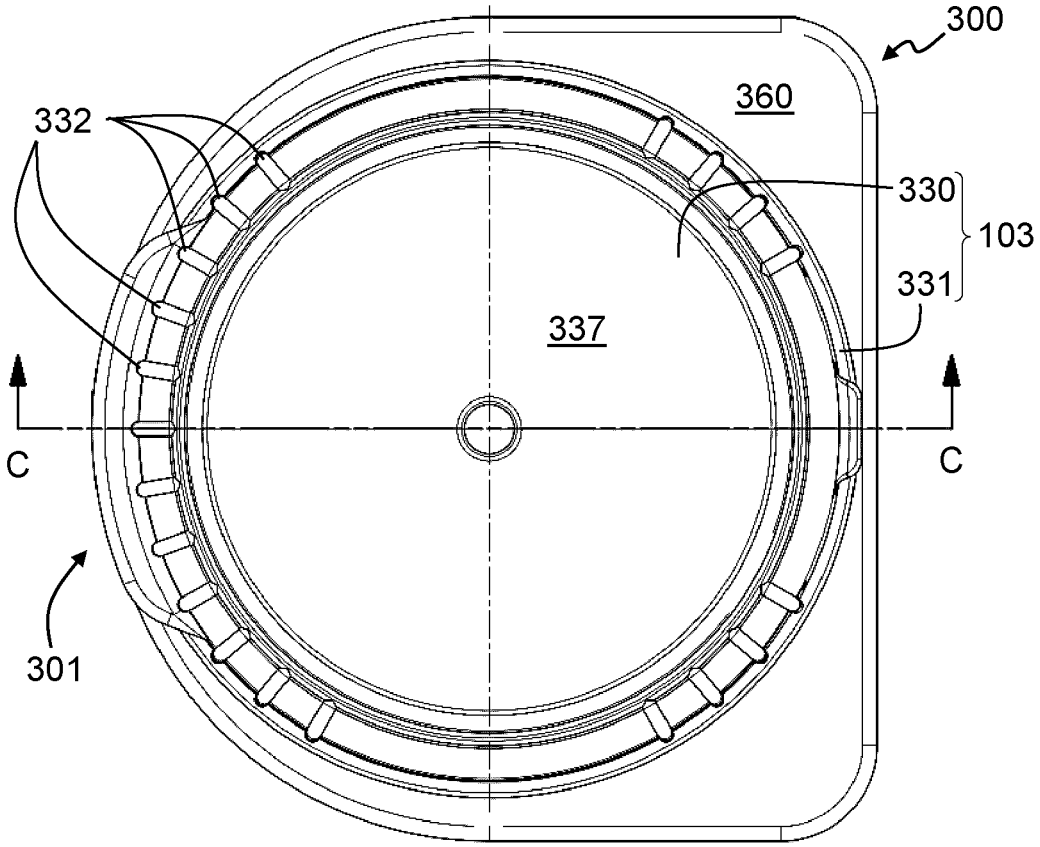
FIG. 14 is a top view of the closure assembly of FIG. 13.

As shown in FIGS. 11 and 12, the tamper evidence band 205 also has a substantially constant height. A series of elevated surfaces 205*a* extend from a top surface 205*b* of the tamper evidence band 205. A series of pockets 250 are formed in the tamper evidence band 205 such that each pocket of the series of pockets extends down from the top surface 205*b* of the tamper evidence band. A respective bridge 251 is formed within each pocket. Each bridge 251 is a narrow band of material that frangibly joins the tamper evidence band 205 to the retaining ring 202. Each bridge 251 tapers toward its connection with the retaining ring 202. The tamper evidence band 205 also includes a plurality of rotational stops 252 projecting from its inner surface, as illustrated more clearly in FIG. 12. Each rotational stop 252 includes a radially sloped surface 253 on one side, but the surface 254 on its opposite side extends radially to provide the rotational stop surface 254.

In use, the cutter 207 is received within the container neck 206 such that their threads are engaged with one another, but such that the cutter 207 is in an uppermost, retracted position. The closure 201 is mounted to the container neck 206 such that the external thread of the neck 206 engages the internal thread 235 of the side wall 231 of the lid 203 of the closure 201, as illustrated in FIG. 9. The closure 201 is then forced onto the container neck 206 by an axial force, such that the internal thread 235 of the closure 201 is forced over the external thread of the container neck 206.

When the closure 201 is rotated in an unscrewing direction, the stop surface 254 of the rotational stops 252 of the tamper evidence band 205 engage those of the container neck 206 and break the bridges 251, thereby breaking or severing the frangible connection between the tamper evidence band 205 and the retaining ring 202. Continued rotation of the closure 201 causes the bridges 234, 234*a* frangibly connecting the retaining ring 202 and leashes 204 to the side wall 231 of the lid 203 to break and separate from the retaining ring 202.

This rotation also causes the tabs 238 depending from the top wall 230 of the lid 203 the closure 201 to engage the internal stops 272 of the cutter 207, thereby driving rotation of the cutter 207. As the cutter 207 rotates, the external threads of the cutter 207 cooperate with the internal threads of the container neck 206 to cause the cutter 207 to translate downwardly along the container neck 206. This rotation and downward translation of the cutter 207 causes the serrated lower edge 273 to engage and cut a hole through a foil (not shown) sealing the carton (not shown) to which the container neck 206 is attached.

Moreover, as the lid 203 is rotated and translates along the container neck 206 by virtue of the threaded engagement therebetween, the leashes 204 stretch between the retaining ring 202, which is held in place by the retaining flange 263 of the container neck 206, and the lid 203. The leashes 204 are sized and shaped to permit the lid 203 to be removed from the neck portion 261 of the container neck 206. When the closure 201 is unscrewed fully, the lid 203 may be manipulated and/or pivoted about the retaining ring 202, by virtue of the leashes 204, thereby to reveal the opening of the container neck 206.

As the lid 203 pivots, the depending tongue 236 is brought into contact with the container neck 206. This contact describes a pivot axis or point about which the lid 203 pivots. As the lid 203 articulates, the tongue 236 rolls and/or slips along the container neck 206 and the leashes 204 are twisted, thereby applying a torsional force to them. The resilience of the leashes 204 causes them to act as a torsion spring or torsion bar in this, twisted state, such that the tongue 236 exerts a force against the container neck 206 for retaining the lid 203 in the fully open position.

Referring now to FIGS. 13 to 17, there is depicted a closure assembly 300 for a carton (not shown), similar to the closure assemblies 100 according to the previous example, wherein like references depicting like features are incremented by a further 100. The closure 301 also has a retaining ring 302 and a lid 303 pivotally connected to the retaining ring 302 by spaced hinges 304, similar to the first example, but in this example the lid 303 engages the container neck 306 by a snap fit connection instead of via threads.

The closure 301 also includes a tamper evidence band 305 frangibly connected to the retaining ring 302. The closure 301 is mounted to a container neck 306 and rotationally engages a cutter 307, which is received within the container neck 306. The cutter 207 is substantially the same as the cutter 107 of the first example and will therefore not be described further.

The retaining ring 302 in this example has a height H described between an upper edge, to which the lid 303 is pivotally connected, and a lower edge, to which the tamper evidence band 305 is frangibly secured. The retaining ring 302 includes a retaining rim 320 projecting internally and spaced about its circumference.

The lid 303 includes a top wall 330, a side wall 331 depending from the periphery of the top wall 330 and gripping ribs 332 extending axially along the external surface of the side wall 331 and radially along a curved transition 333 between the side wall 331 and the top wall 330. The side wall 331 is frangibly connected to the retaining ring 302 by a series of bridges 334. The side wall 331 includes a trapezoidal void within which the hinges 304 are located, which describes a relief on each of its sides for providing clearance between the side wall 331 and the container neck 206 as it pivots to an open position.

The side wall 331 includes an internal lip 335, which projects from an inner surface and on the opposite side thereof to the hinges 304, and a gripping tab GT projecting from an outer surface and substantially aligned, but slightly below; the internal lip 335. The side wall 331 also includes a tongue 336 projecting radially outwardly from an upper edge of the void. The hinges 304 extend from the upper edge of the void and join the upper edge of the retaining ring 302. The retaining ring 302 also includes a pair of triangular tabs 321 and a locking tab 322, both of which project upwardly from its upper edge and into the void in the side wall 331. The tabs 321 are on either side of the hinges 304 and fill the outer, relief portions of the void, whilst the locking tab 322 is between the hinges 304. The locking tab 322 also includes a recess 323 across an upper portion thereof.

Figure 15:
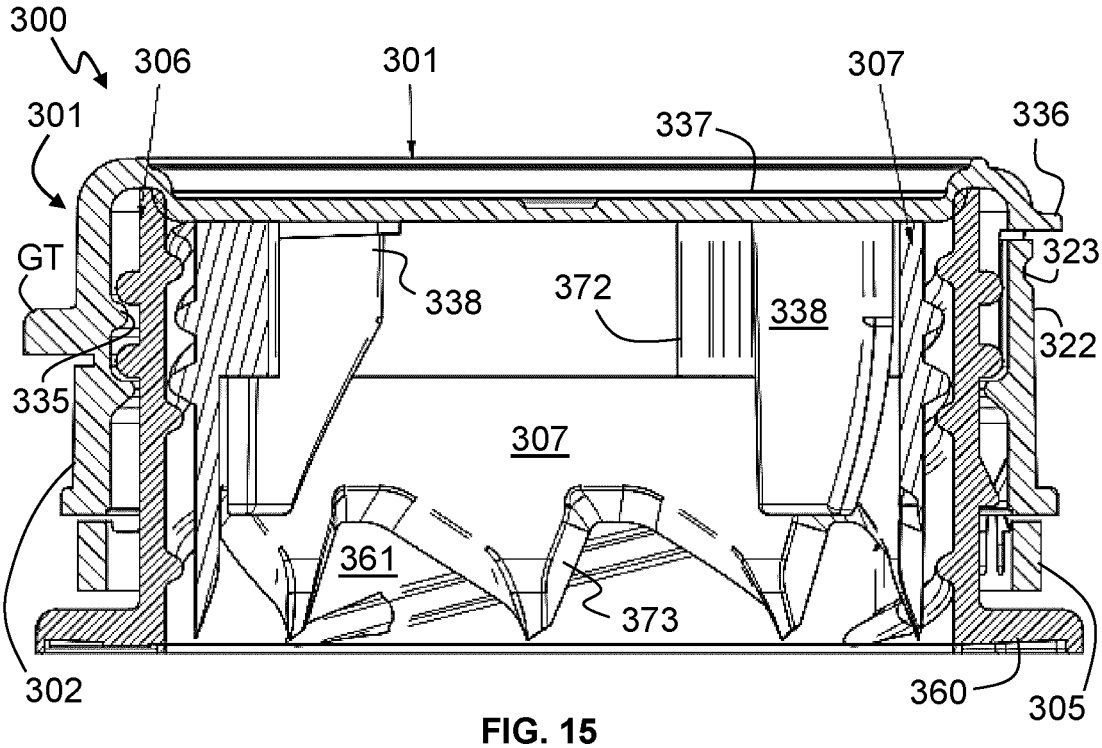
FIG. 15 is a section view of the closure assembly along line C-C of FIG. 14.
Figure 16:
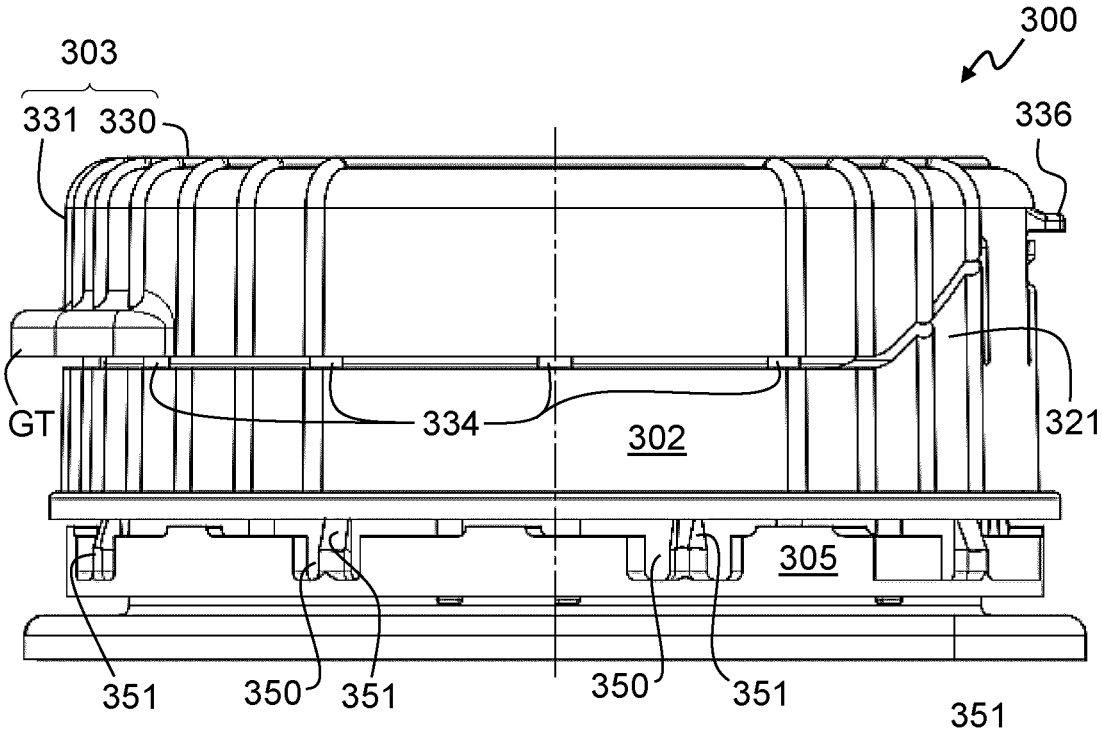
FIG. 16 is a side view of the closure assembly of FIGS. 7 to 9.
Figure 17:
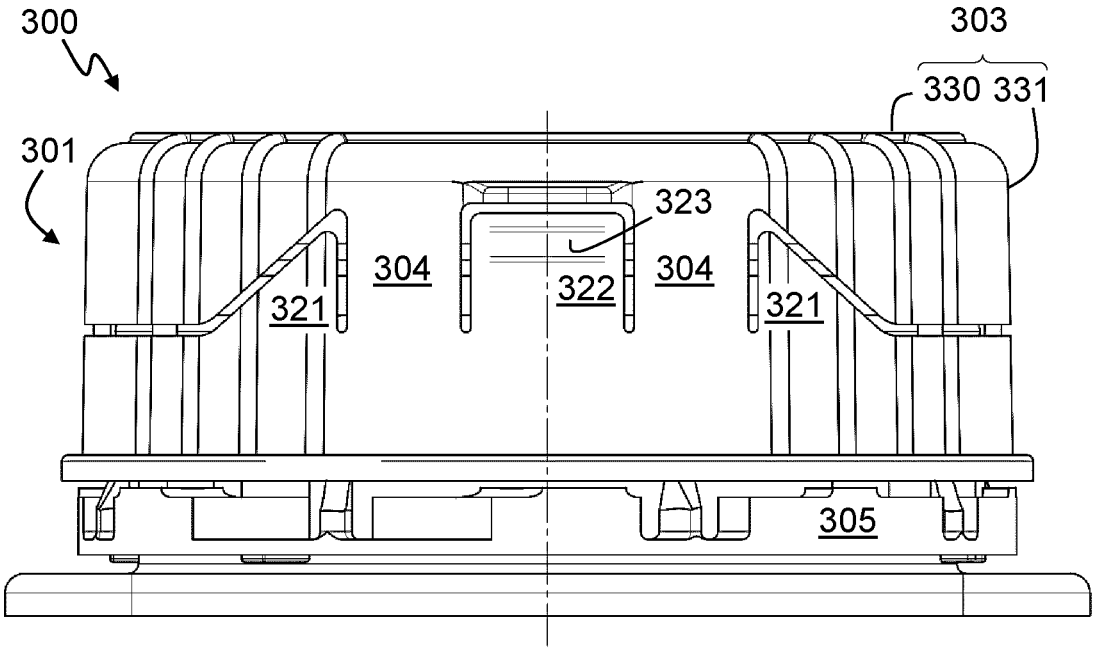
FIG. 17 is a rear view of the closure assembly of FIGS. 7 to 10.
Figure 18:
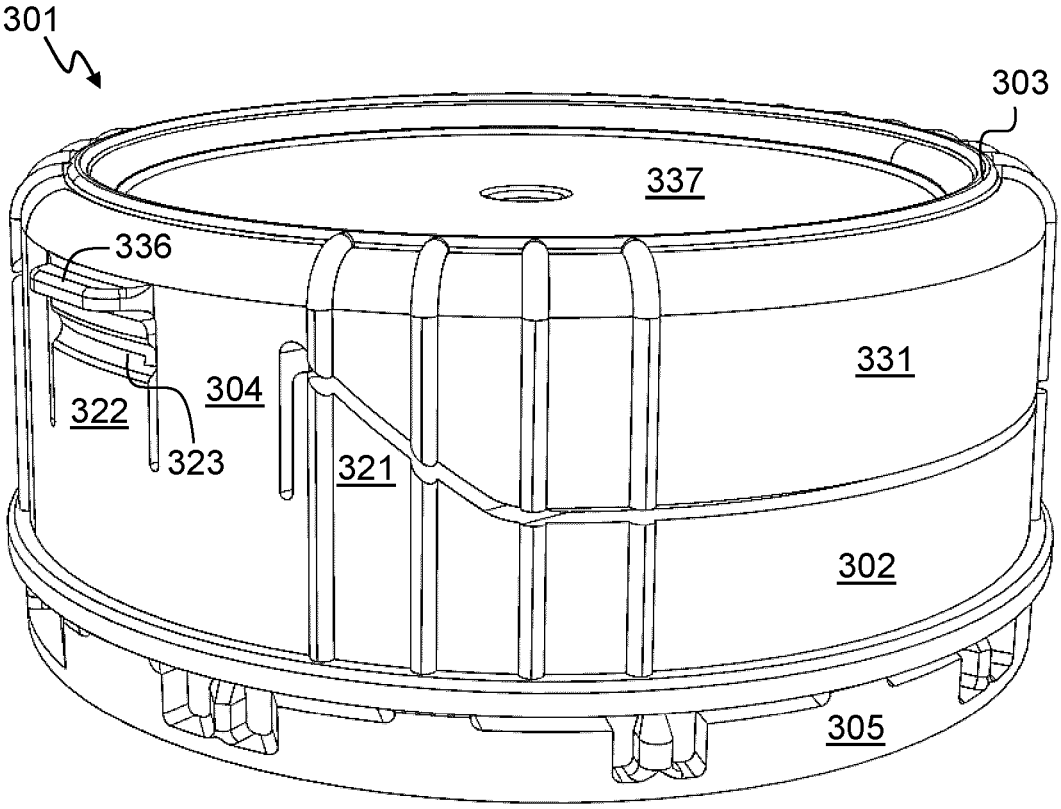
FIG. 18 is a rear perspective view of the closure of the closure assembly of FIGS. 13 to 17.

The top wall 330 includes a depression 337, which creates a sealing rim that seals against the container neck 306, as shown more clearly in FIG. 15. Part-cylindrical tabs 338 depend from the top wall 330 for engaging the cutter 307.

Figure 19:
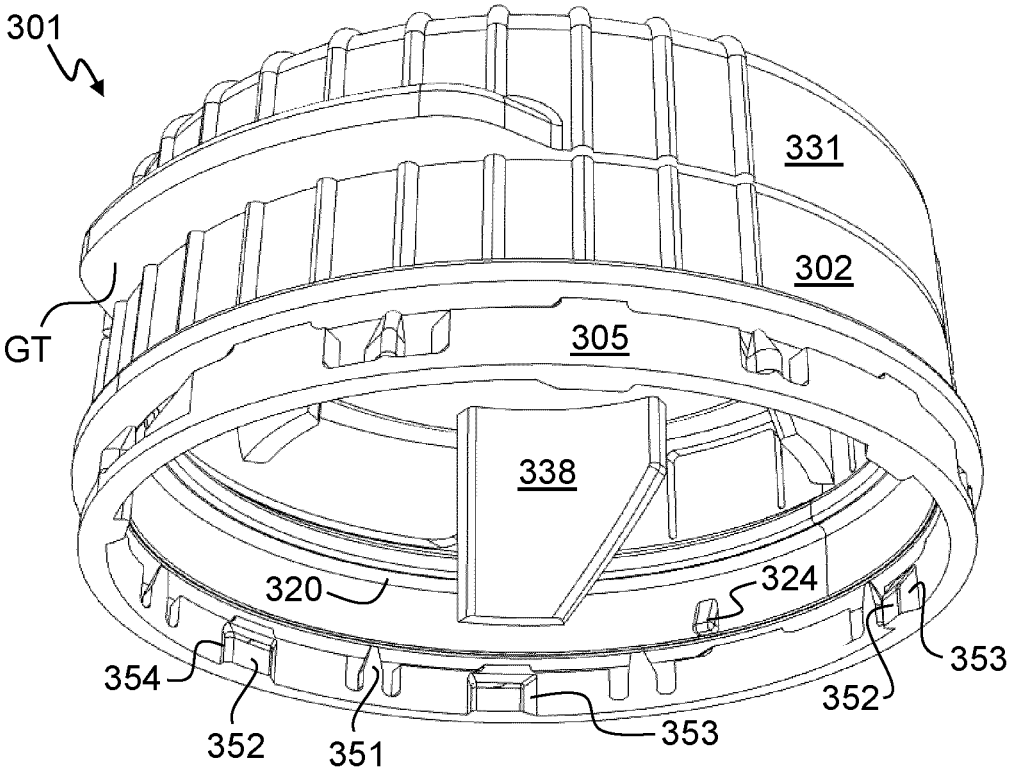
FIG. 19 is a front perspective view of the closure of FIG. 18 from below.

The tamper evidence band 305 also has a substantially constant height, but with a series of pockets 350 within which a respective bridge 351 is formed. Each bridge 351 is a narrow band of material that frangibly joins the tamper evidence band 305 to the retaining ring 302. Each bridge 351 tapers toward its connection with the retaining ring 302, as illustrated more clearly in FIG. 19. The tamper evidence band 305 also includes a plurality of rotational stops 352 projecting from its inner surface, which is also shown in FIG. 19. Each rotational stop 352 includes a radially sloped surface 353 on one side, but the surface 354 on its opposite side extends radially to provide the rotational stop surface 354.

Figure 20:
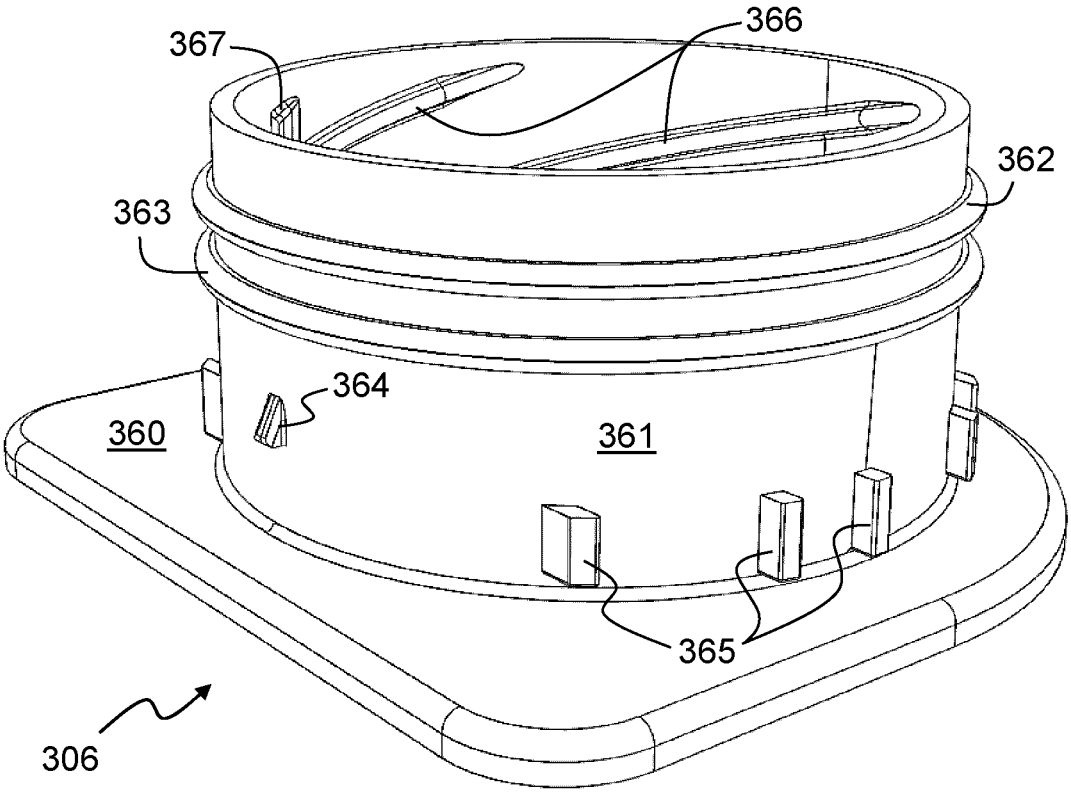
FIG. 20 is a perspective view of the container neck of the closure assembly of FIGS. 13 to 17.

The container neck 306, shown more clearly in FIG. 20, includes a mounting flange 360 for mounting the container neck 306 to a carton (not shown) and a hollow cylindrical neck portion 361 projecting from the mounting flange 360. The neck portion 361 includes a first external flange 362 projecting radially for cooperating with the internal lip 335 of the side wall 331 of the lid 303 of the closure 301. The neck portion 361 also includes a second, retaining flange 363 projecting radially below the first external flange 362, an external locating projection 364 at an intended rear side of the container neck 306 and a series of stops 365 projecting outwardly below the retaining flange 363 and locating projection 364.

The retaining ring 302 also includes an internal locating projection 324, which is directly below the locking tab 322, which cooperates with the locating projection 364 to provide a rotational stop for orienting the closure 301 in a predetermined position relative to the container neck 306. Advantageously, the container neck 306 may include a pair of spaced locating projections 364, between which the locating projection 324 of the retaining ring 302 may be captivated when it is rotated to the predetermined position. This would lock the closure 301 in place against rotation. The locating projections 364, 324 both have a triangular cross-section along a radial plane, with an upper, tapered surface and a lower surface that extends radially.

As in the previous examples, the neck portion 361 also includes a series of internal threads 366 and a series of internal stops 367 projecting upwardly from the internal threads 366 and inwardly from the neck portion 361.

In use, the cutter 307 is received within the container neck 306 such that their threads 366 are engaged with one another, but such that the cutter 307 is in an uppermost, retracted position. The closure 301 is mounted to the container neck 306 by applying an axial force therebetween until the retaining rim 320 of the retaining ring 302 passes over both the external and retaining flanges 362, 363 of the neck portion 361 and the internal lip 335 of the side wall 331 of the lid 303 passes over and engages the external flange 362, as illustrated in FIG. 15.

The skilled person will appreciate that the radially sloped surfaces 353 of the rotational stops 352 enable the closure 301 to be rotated relative to the container neck 306 in a first direction without breaking the bridges 351 that frangibly join the tamper evidence band 305 to the retaining ring 302, since they ride up and over the stops 365 of the container neck 306. However, when the closure 301 is rotated in the opposite direction, the stop surfaces 354 of the rotational stops 352 of the tamper evidence band 305 engage the stops 365 of the container neck 306 and break the bridges 351, thereby breaking or severing the frangible connection between the tamper evidence band 305 and the retaining ring 302.

Continued rotation of the closure 301 causes the tabs 338 depending from the top wall 330 of the lid 303 the closure 301 to engage the internal stops 372 of the cutter 307, thereby driving rotation of the cutter 307. As the cutter 307 rotates, the threaded engagement between it and the container neck 306 cause the cutter 307 to translate downwardly along the container neck 306. This rotation and downward translation of the cutter 307 causes the serrated lower edge 373 to engage and cut a hole through a foil (not shown) sealing the carton (not shown) to which the container neck 306 is attached. At this point, the locating projections 324, 364 engage to provide a rotational stop and the closure 301 is oriented such that the grip tab GT of the lid 303 is at the front of the carton (not shown).

The closure 301 is opened by gripping the grip tab GT and urging it upwardly, such that the bridges 334 frangibly connecting the side wall 331 to the retaining ring 302 break and the internal lip 335 of the side wall 331 of the lid 303 passes over and disengages the external flange 362 of the neck portion 361 of the container neck 306. The lid 303 may be pivoted about the hinges 304 to reveal the opening of the container neck 306. When the lid is in its fully open position, the resilience of the hinges 304 urges the tongue 336 into the recess 323 of the locking tab 322, thereby retaining the lid 303 in an open position.

It will be appreciated by those skilled in the art that several variations to the aforementioned embodiments are envisaged without departing from the scope of the invention. It will also be appreciated by those skilled in the art that any number of combinations of the aforementioned features and/or those shown in the appended drawings provide clear advantages over the prior art and are therefore within the scope of the invention described herein.

The invention claimed is:

1. A closure for a container having a neck with an annular flange and at least one rotational stop, the closure comprising:

a retaining ring for securement around the container neck below the annular flange;

a lid for selectively closing an opening of the container neck, the lid comprising a top wall and a side wall depending from the top wall;

a tongue depending from the top wall;

a leash on each side of the tongue and connecting the lid to the retaining ring for allowing the lid to be removed from the container neck while remaining attached to the retaining ring; and a tamper evidence band frangibly connected to the retaining ring and having a rotational stop for engaging the rotational stop of the container neck to separate the tamper evidence band from the retaining ring on first rotation of the closure relative to the neck, wherein the tamper evidence band has a substantially constant height, wherein a series of elevated surfaces extend from a top surface of the tamper evidence band, wherein a series of pockets are formed in the tamper evidence band such that each pocket of the series of pockets extends down from the top surface of the tamper evidence band, wherein a bridge located in each pocket of the series of pockets frangibly joins the tamper evidence band and the retaining ring, and wherein the leashes act, in use, as a torsion spring when the lid is actuated to a fully open position such that the tongue exerts a force against the container neck for retaining the lid in the fully open position.

2. A closure according to claim 1, wherein the rotational stop of the tamper evidence band comprises a radially sloped surface on a first side thereof, which is configured to engage the rotational stop of the container neck to enable the closure to be rotated in a first direction to mount the closure onto the container neck without severing the tamper evidence band, and a radial surface on a second side thereof, opposite the first side, which is configured to engage the rotational stop of the container neck to prevent rotation of the tamper evidence band relative to the container neck in a second, unscrewing direction, opposite the first direction, for removing the lid of the closure from the container neck.

3. A closure according to claim 1, wherein the retaining ring comprises an annulus having a substantially constant height with an inwardly projecting retaining rim or one or more retaining projections or cams for engaging the annular flange of the container neck.

4. A closure according to claim 1, wherein the leashes each comprise first and second portions, which are positioned at an angle in relation to each other when the closure is in a fully closed position, the first portions depend from the lid and diverge from one another.

5. A closure according to claim 4, wherein the tongue is in a void in the side wall, the void comprising a pair of flanks or chamfers describing a relief for inhibiting interference between the lid and the container neck as the lid is pivoted toward an open position, the first portion of each leash extends along a respective flank or chamfer of the void, the second portion of each leash extending from the first portion, along a circumferential portion of a lower edge of the side wall and being formed within the retaining ring.

6. A closure according to claim 1, wherein the tongue comprises a first projecting lip positioned at a free end of the tongue, a second projecting lip positioned at a root end of the tongue and a rib which extends between the first and second projecting lips.

7. A closure assembly comprising:

a closure according to claim 1;

a container neck to which the closure is secured or securable, the container neck comprising an opening, the annular flange, the at least one rotational stop, one or more internal threads and an external thread for engaging a thread on an inner surface of the side wall of the lid; and a cutter received or receivable within the container neck, the cutter comprising one or more external threads, a sharp and/or serrated lower edge and one or more stops for cooperating with one or more tab(s) or coupling feature(s) of the closure;

wherein the closure assembly is configured such that rotation, in use, of the closure causes the cutter to rotate therewith, to engage the container neck via the one or more external threads and to translate along the container neck for causing the sharp and/or serrated lower edge of the cutter to pierce and/or cut through a membrane of the container.

8. A mold stack describing a closure according to claim 1.

9. The closure of claim 1, wherein when the closure is rotated in an unscrewing direction, the rotational stop of the tamper evidence band engages the rotational stop of the container neck to separate the tamper evidence band from the retaining ring.

10. The closure of claim 1, wherein each pocket of the series of pockets extends completely through the tamper evidence band between an inner surface and an outer surface of the tamper evidence band.

* * * * *